US010697717B2

(12) United States Patent
Hartfield et al.

(10) Patent No.: US 10,697,717 B2
(45) Date of Patent: Jun. 30, 2020

(54) WATER HEAD FOR AN EVAPORATOR

(71) Applicant: TRANE INTERNATIONAL INC., Davidson, NC (US)

(72) Inventors: Jon Phillip Hartfield, La Crosse, WI (US); Harry Kenneth Ring, Houston, MN (US); Gang Wang, Holmen, WI (US); Ruitao Liu, Shanghai (CN)

(73) Assignee: TRANE INTERNATIONAL INC., Davidson, NC (US)

( * ) Notice: Subject to any disclaimer, the term of this patent is extended or adjusted under 35 U.S.C. 154(b) by 22 days.

(21) Appl. No.: 14/434,986

(22) PCT Filed: Oct. 10, 2012

(86) PCT No.: PCT/CN2012/082679
§ 371 (c)(1),
(2) Date: Apr. 10, 2015

(87) PCT Pub. No.: WO2014/056151
PCT Pub. Date: Apr. 17, 2014

(65) Prior Publication Data

US 2015/0285570 A1 Oct. 8, 2015

(51) Int. Cl.
*F28F 9/02* (2006.01)
*F28D 7/16* (2006.01)
(Continued)

(52) U.S. Cl.
CPC ..... *F28F 9/026* (2013.01); *F25B 39/02* (2013.01); *F25B 39/028* (2013.01);
(Continued)

(58) Field of Classification Search
CPC ..... F28F 9/0214; F28F 9/0263; F25B 39/028; F25B 2339/0242; F28D 7/1607; F28D 2021/0071
(Continued)

(56) References Cited

U.S. PATENT DOCUMENTS 1,782,409 A 11/1930 Chute
1,856,963 A * 5/1932 Martin ..... F28F 9/0217 165/176
(Continued)

FOREIGN PATENT DOCUMENTS

CN 102384692 A 3/2012
DE 19942458 A1 * 3/2000 ..... F28D 1/035
(Continued)

OTHER PUBLICATIONS

International Search Report and Written Opinion for International Application No. PCT/CN2012/082679, dated Jul. 18, 2013, 12 pgs.
(Continued)

*Primary Examiner* — Leonard R Leo
(74) *Attorney, Agent, or Firm* — Hamre, Schumann, Mueller & Larson, P.C.

(57) ABSTRACT

Embodiments of a water head for an evaporator in a HVAC system are provided. The water head may have a fluid entrance and a fluid exit in a side-by-side arrangement on one end of the water head, and a distribution chamber and a collection chamber in a top-down arrangement on opposite side of the water head. The distribution chamber and the collection chamber are configured to be in fluid communication with inlets and outlets of a heat exchanging tube bundle respectively. The distribution chamber and the collection chamber can be configured to have continuously smooth surface contours to help reduce pressure drop and fluid separation, and promote advantageous distribution of the process fluid among heat exchanging tubes when a process fluid flows between the fluid entrance or the fluid exit, and the distribution chamber or the collection chamber respectively.

9 Claims, 7 Drawing Sheets

(51) Int. Cl.
*F25B 39/02* (2006.01)
*F28D 1/053* (2006.01)
*F28D 21/00* (2006.01)

(52) U.S. Cl.
CPC ..... *F28D 1/05308* (2013.01); *F28D 7/1607* (2013.01); *F28F 9/02* (2013.01); *F25B 2339/0242* (2013.01); *F28D 2021/0071* (2013.01); *F28F 9/0214* (2013.01); *F28F 9/0263* (2013.01)

(58) Field of Classification Search
USPC ..... 165/174, 158, 176
See application file for complete search history.

(56) References Cited

U.S. PATENT DOCUMENTS 4,190,101 A * 2/1980 Hartmann ..... F28F 9/0241 165/158
4,396,060 A * 8/1983 Schenk ..... F28F 9/0217 165/176
4,502,530 A 3/1985 Huenniger
4,520,867 A 6/1985 Sacca et al.
4,559,688 A 12/1985 Abu-Isa et al.
4,596,287 A 6/1986 Wissmath
5,123,482 A * 6/1992 Abraham ..... F28D 1/0535 165/173
5,265,673 A 11/1993 Hucsko
5,275,236 A 1/1994 Le Gauyer
5,464,057 A * 11/1995 Albano ..... C10G 9/002 165/174
5,685,366 A 11/1997 Voss et al.
5,934,367 A 8/1999 Shimmura et al.
5,964,281 A 10/1999 Voss et al.
6,116,335 A * 9/2000 Beamer ..... F28F 9/0265 165/174
6,167,713 B1 * 1/2001 Hartfield ..... F28D 3/04 165/160
2006/0236718 A1 10/2006 Lundberg
2009/0090493 A1 * 4/2009 Slaughter ..... F28D 7/1692 165/145
2009/0236086 A1 9/2009 Higashiyama et al.
2010/0031698 A1 2/2010 Higashiyama
2011/0155358 A1 * 6/2011 Galahroudi ..... F28F 9/0214 165/173

FOREIGN PATENT DOCUMENTS

DE 19857382 A1 * 6/2000 ..... F28D 1/035
EP 0745821 12/1996
EP 1557629 A1 7/2005
JP 04000189 A * 1/1992 ..... F28D 1/05391
JP 04225796 8/1992
JP 3996258 B2 10/2007
JP 2009-097776 5/2009
WO WO0131278 A1 * 5/2001

OTHER PUBLICATIONS

Examination Report; Indian Patent Application No. 2661/CHENP/2015, dated Aug. 16, 2019 (7 pages).

* cited by examiner

WATER HEAD FOR AN EVAPORATOR

FIELD OF TECHNOLOGY

Embodiments disclosed herein relate generally to a heating, ventilation and air conditioning (HVAC) system. More specifically, embodiments disclosed herein relate to a water head of an evaporator of a HVAC system.

BACKGROUND

An evaporator of a HVAC system typically has a tube bundle in a shell design. The tube bundle typically includes a plurality of tubes configured to carrya process fluid, such as water. Refrigerant in the shell can exchange heat with the process fluid in the tube bundle to cool down the process fluid.

Typically, the heat exchanging tubes extend a full length of the evaporator. In a single-pass evaporator design, a process fluid typically flows into inlets of the heat exchanging tubes from one end of the evaporator, through the full length of the evaporator, then out of outlets of the heat exchanging tubes from the other end of the evaporator. In a two pass evaporator design, the process fluid typically flows into inlets of first pass heat exchanging tubes from one end of the evaporator. The process fluid flows the full length of the evaporator through the first pass heat exchanging tubes, makes a turn in a returning box positioned at the other end of the evaporator, then flows into second pass heat exchanging tubes to return to outlets located at the same end as the inlets. Some evaporators may also have a four-pass design.

A water head is a device positioned on the end of the evaporator, and configured to distribute or receive the process fluid from the tube bundle. For example, in some evaporators, the inlets of the first pass heat exchanging tubes are positioned at a bottom section of the end of the evaporator, while the outlets of the second pass heat exchanging tubes are positioned at a top section of the end of the evaporator. The water head may have a fluid entrance and a fluid exit that have an "under-over" design, i.e., the fluid entrance is positioned at a bottom section of the water head and is configured to be in fluid communication with the inlets of the first pass heat exchanging tubes; and the fluid exit is positioned at a top section of the water head and is configured to be in fluid communication with the outlets of the second pass heat exchanging tubes.

In some other evaporators, the inlets of the first pass heat exchanging tubes may be positioned toward a left (or right) side of the evaporator, while the outlets of the second pass heat exchanging tubes may be positioned toward a right (or left) side of the evaporator. Accordingly, a water entrance and the water exit of a water head may be configured to have a "side-by-side" configuration.

SUMMARY

In the following description, embodiments of a water head are described. The water head may help reduce pressure drop and fluid flow separations when a process fluid is distributed or received by the water head.

In some embodiments, the water head may have a fluid entrance and a fluid exit in a "side-by-side" arrangement. The fluid entrance may be configured to be in fluid communication with a distribution opening through a distribution chamber, and the fluid exit may be configured to be in fluid communication with a collection opening through a collection chamber. In some embodiments, the distribution opening and the distribution chamber may be configured to have a "top-bottom" arrangement, and divided by a partition. The partition has a first partition surface and a second partition surface. The first partition is configured to generally face the distribution chamber and the second partition is configured to generally face the collection chamber.

In some embodiments, the distribution chamber may be configured to have a reversed funnel-like transition with continuously smooth surface contours connecting the fluid entrance and the distribution opening. The reversed funnel-like transition may be configured to expand in a direction of a fluid flow through the reverse funnel-like transition. In some embodiments, the collection chamber may be configured to have a funnel-like transition with continuously smooth surface contours connecting the collection opening and the fluid exit. The funnel-like transition may be configured to funnel in the direction of a fluid flow through the funnel-like transition.

In some embodiments, the first partition surface of the distribution chamber may be configured to have a conically shaped portion concaved into the collection portion, and the conically shaped portion may be configured to direct a portion of a fluid toward the distribution opening when the fluid flows between the fluid entrance and the distribution opening.

In some embodiments, the second partition surface of the collection chamber may be configured to have a conically shaped portion concaved into the distribution portion, and the conically shaped portion may be configured to turn a portion of a fluid toward the fluid exit when the fluid flows between the collection opening and the fluid exit.

The funnel-like and reversed funnel-like transitions with smooth surface contours of may help reduce fluid flow separations and pressure drop when the fluid flows between the fluid entrance and the distribution opening, as well as between the collection opening and the fluid exit. The funnel-like and reverse funnel-like transitions with smooth surface contours may also help promote advantageous distribution of the process fluid among the heat exchanging tubes.

Other features and aspects of the fluid management approaches will become apparent by consideration of the following detailed description and accompanying drawings.

BRIEF DESCRIPTION OF THE DRAWINGS

Reference is now made to the drawings in which like reference numbers represent corresponding parts throughout.

FIG. 1A illustrates a side view of the evaporator. FIG. 1B illustrates an end view of the evaporator.

FIG. 2A is an elevated front perspective view of the water head. FIGS. 2B and 2C are back views of the water head. FIG. 2D is a sectional view of the water head along line A-A in FIG. 2A. FIG. 2E is a sectional view of the water head along line B-B in FIG. 2A. FIG. 2F is a sectional view of the water head along line C-C in FIG. 2A. FIG. 2G is an enlarged view for an area G in FIG. 2A.

DETAILED DESCRIPTION

Figure 1A:
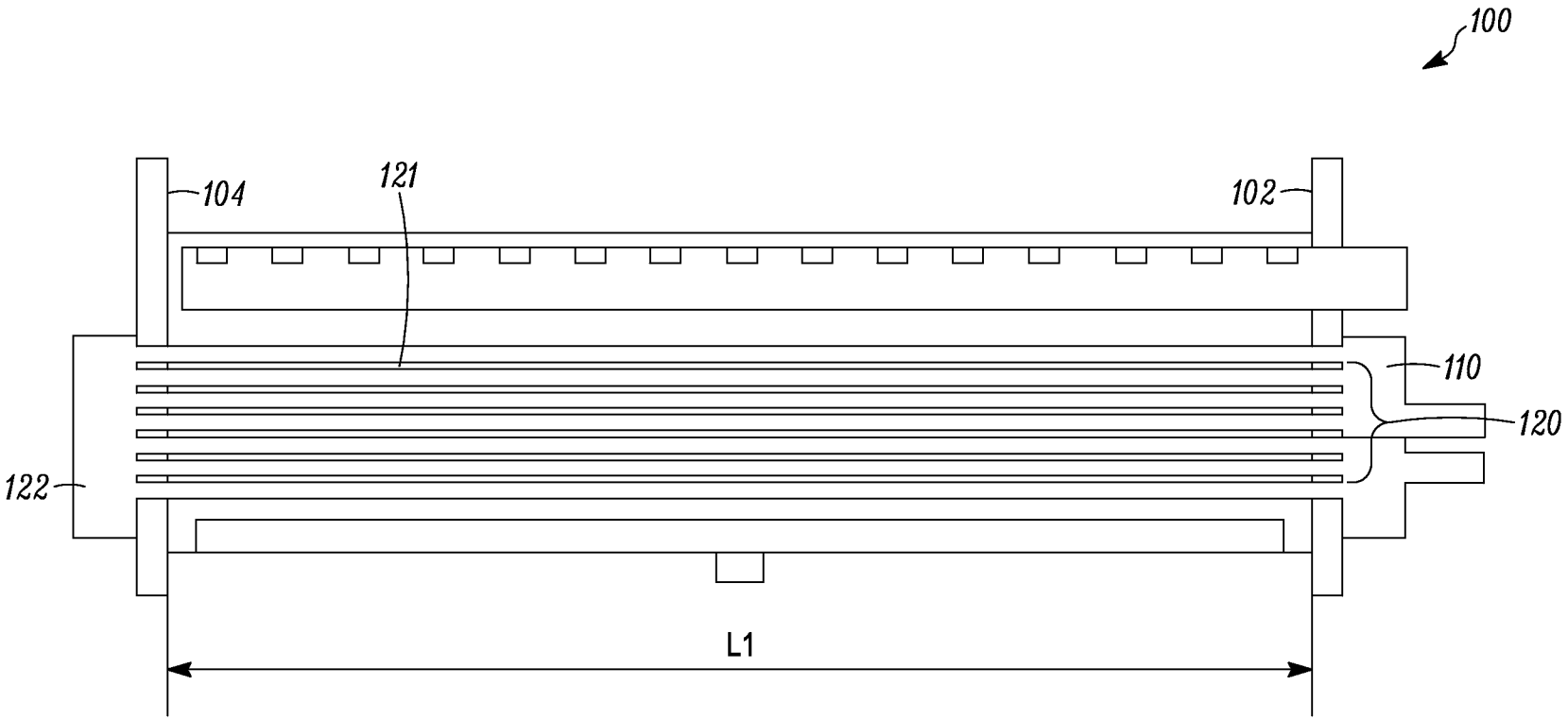
FIGS. 1A and 1B illustrated a schematic view of an evaporator with a water head.

A water head is a device configured to distribute a process fluid, such as water, to heat exchanging tubes of an evaporator, and/or receive the process fluid after the process fluid being cooled down by the evaporator in the heat exchanging tubes. The water head is typically positioned at one longitudinal end of an evaporator. In some evaporators, the water head may have two portions, a fluid distribution portion and a fluid collection portion. The fluid distribution portion is in fluid communication with inlets of first pass heat exchanging tubes, and the fluid collection portion is in fluid communication with outlets of second pass heat exchanging tubes. The process fluid is directed into the fluid distribution portion through a fluid entrance of the water head and distributed into the inlets of the first pass heat exchanging tubes, then flows out the outlets of the second pass heat exchanging tubes and is received by the fluid collection portion and directed to a fluid exit of the water head. Depending on the arrangements of the heat exchanging tubes, the fluid entrance (and the fluid distribution portion) and the fluid exit (and the fluid collection portion) can be arranged in an under-over arrangement, or a "side-by-side" arrangement.

In some evaporators, the heat exchanging tubes may occupy only a lower portion of the shell, and the inlets and the outlets of the heat exchanging tubes are arranged in a "top-bottom" fashion. In these evaporators, if the fluid entrance and the fluid exit are arranged in an "under-over" fashion, diameters of the fluid entrance and the fluid exit may be limited because a height of the water head may be restricted. The limited diameters of the fluid entrance and/or the fluid exit may increase pressure drop when the process fluid flows through the water head.

In the following description, embodiments of a water head are described. In some embodiments, the water head may have a fluid entrance and a fluid exit in a "side-by-side" arrangement, and have a distribution opening in fluid communication with the fluid entrance and a collection opening in fluid communication with the fluid exit in an "under-over" arrangement. In some embodiments, a distribution chamber with continuously smooth surface contours is configured to connect the fluid entrance and the distribution opening; and a collection chamber with continuously smooth surface contours is configured to connect the collection opening and the fluid exit. The distribution chamber may be configured to disperse the fluid when the fluid flowing from the fluid entrance to the distribution opening; and the collection chamber may be configured to contract the fluid when the fluid flowing from the collection opening to the fluid exit. In some embodiments, the distribution and the collection chambers may be configured to have funnel-like transitions. The funnel-like transitions and smooth surface may help reduce fluid flow separations when the fluid flows between the fluid entrance and the distribution opening, as well as between the collection opening and the fluid exit. The water head as described herein may also be compact and help reduce pressure drop in the process fluid within the water head in operation. The water head as described herein may also help enhance heat exchanging efficiency by promoting advantageous distribution of process fluid among the heat exchanging tubes.

References are made to the accompanying drawings that form a part hereof, and in which is shown by way of illustration of the embodiments may be practiced. It is to be understood that the terms used herein are for the purpose of describing the figures and embodiments and should not be regarded as limiting the scope of the present application.

Figure 1B:
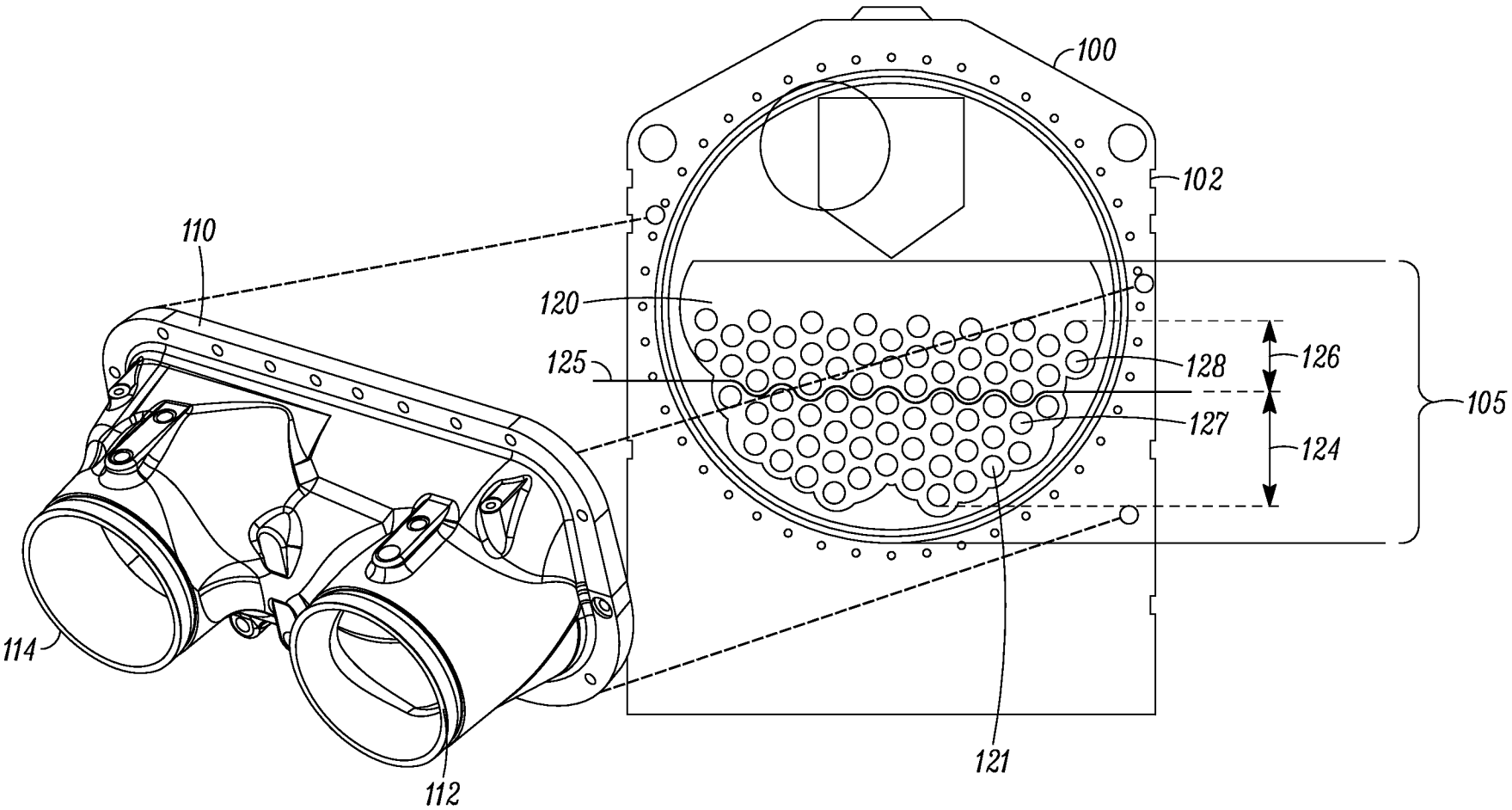

Referring to FIGS. 1A and 1B, an embodiment of an evaporator 100 of a two-pass design with a water head 110 is disclosed. As illustrated in FIG. 1A, the evaporator 100 encloses a tube bundle 120 with a plurality of heat exchanging tubes 121.

FIG. 1B illustrates an end view from the first end 102 of the evaporator 100. The water head 110 is shown separated from the evaporator 100 for clarification. The tube bundle 120 of the evaporator 100 as illustrated in FIGS. 1A and 1B is positioned toward a lower portion 105 of the evaporator 100.

An imaginary dividing line 125 divides the heat exchanging tubes 121 of the tube bundle 120 into first pass heat exchanging tubes 124 located toward a bottom of the tube bundle 120, and second pass heat exchanging tubes 126 located toward a top of the tube bundle 120. The first pass heat exchanging tubes 124 have inlets 127 at the first end 102, and the second pass heat exchanging tube 124 have outlets 128 at the first end 102.

The water head 110 has a fluid entrance 112 and a fluid exit 114. When the water head 110 is installed to the first end 102 of the evaporator 100 as illustrated in FIGS. 1A and 1B, the fluid entrance 112 and the fluid exit 114 are in a side-by-side configuration.

The fluid entrance 112 is configured to be in fluid communication with the inlets 127 of the first pass heat exchange tubes 124. The fluid exit 114 is configured to be in fluid communication with the outlets 128 of the second pass heat exchange tubes 126.

In operation, the fluid entrance 112 is configured to distribute the process fluid, such as water, into the inlets 127 of the first pass heat exchanging tubes 124 from the first end 102 of the tube bundle 120. The process fluid extends a full length L1 of the evaporator 100 in the first pass heat exchanging tubes 124, makes a "U" turn in a return box 122 positioned at a second end 104 of the evaporator 100, extends the full length L1 of the evaporator 100 again in the second pass heat exchanging tubes 126 to return to the first end 102, and exit the outlets 128 of the second pass exchanging tubes 126. The process fluid then flows out of the evaporator 100 from the fluid exit 114.

Figure 2A:
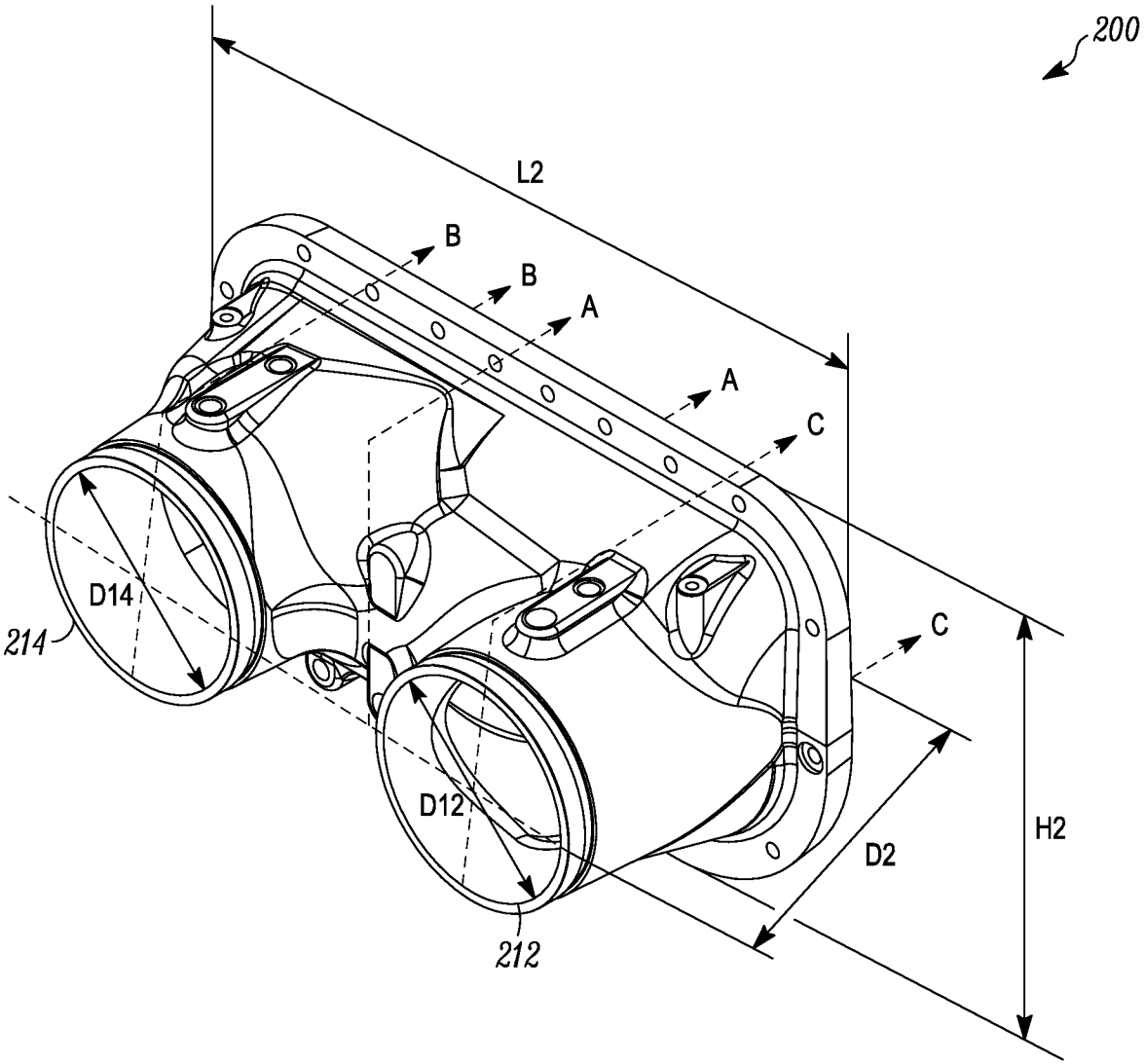
FIG. 2A to 2G illustrate different aspects of an embodiment of a water head.

FIGS. 2A to 2G illustrate different aspects of a water head 200 for an evaporator (e.g. the evaporator 100 in FIG. 1A). FIG. 2A illustrates a front perspective view of the water head 200. The water head 200 has a length L2 and a height H2. Since the water head 200 is configured to cover a lower portion (e.g. the lower portion 105 of the evaporator 100 in FIG. 1A) of a cylinder shaped evaporator (e.g. the evaporator 100 in FIG. 1A), the length L2 is typically longer than the height H2.

Relative to a vertical direction V2 defined by the height H2, a fluid entrance 212 and a fluid exit 214 are arranged in a side-by-side fashion.

Figure 2B:
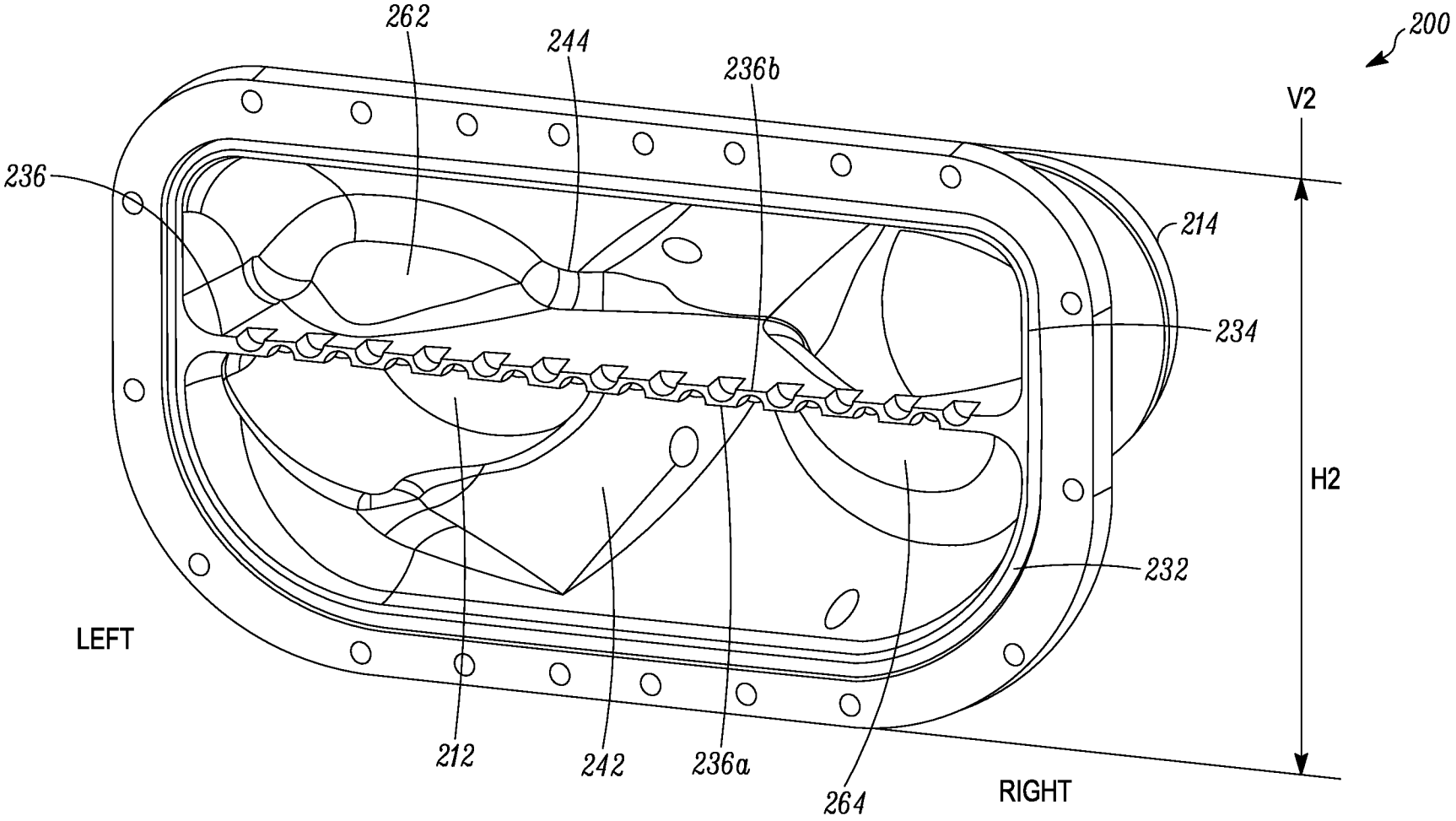
Figure 2C:
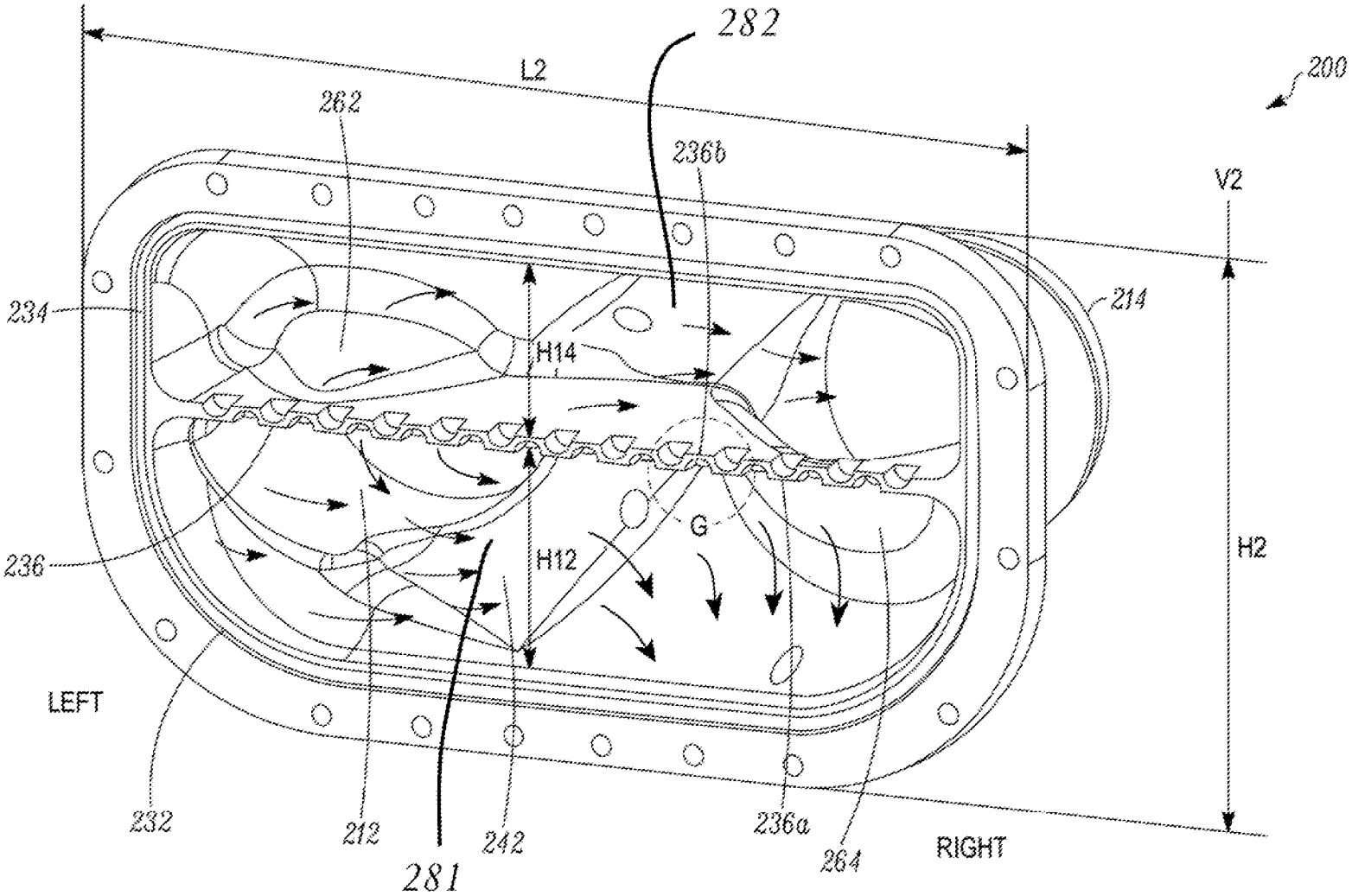

FIGS. 2B and 2C illustrates back views of the water head 200. The water head 200 has a distribution opening 232 and a collection opening 234. Relative to the vertical direction V2 defined by the height H2, the distribution opening 232 and the collection opening 234 are arranged in a "top-bottom" fashion: the distribution opening 232 is positioned on top of the collection opening 234 and is divided by a partition 236.

When the water head 200 is installed on the evaporator, the distribution opening 232 is configured to be in fluid communication with inlets of heat exchanging tubes (e.g. the inlets 127 of the first pass heat exchanging tubes 124 of the tube bundle 120 in FIG. 1B) of the evaporator. The collection opening 234 is configured to be in fluid communication with outlets of second pass heat exchanging tubes (e.g. the outlets 128 of the second pass heat exchanging tubes 126 in FIG. 1B) of the evaporator. The collection opening 234 is positioned on top of the distribution opening 232 when the water head is installed to the evaporator. When the water head 200 is installed to the evaporator, the partition 236 can be roughly aligned with the imaginary line (e.g. the imaginary line 125 in FIG. 1B) dividing the tube bundle into the firs pass heat exchanging tubes and the second pass heat exchanging tubes.

The partition 236 is configured to divide the water head 200 into a distribution chamber 242 and a collection chamber 244. From the back views as shown in FIGS. 2B and 2C, the partition 236 is positioned between the distribution opening 232 and the collection opening 234.

In operation, a process fluid flows into the fluid entrance 212 and then into the distribution chamber 242 connecting the fluid entrance 212 and the distribution opening 232. The process fluid is then distributed into the inlets of the first pass heat exchanging tubes through the distribution opening 232. The process fluid flows through the first pass heat exchanging tubes and the second pass heat exchanging tubes, flows out of the outlets of the second pass heat exchanging tubes, and returns to the collection chamber 244 through the collection opening 234. The collection chamber 244 is configured to connect the collection opening 234 and the fluid exit 214. The process fluid then flows out of the fluid exit 214 through the collection chamber 244.

As illustrated in FIG. 2A, the water head 200 has a depth D2. In operation, when the process fluid enters the fluid entrance 212 and exits the fluid exit 214, fluid flow directions are generally parallel to a direction defined by the depth D2. However, in the distribution chamber 242 and the collection chamber 244, the directions of the fluid flows are generally parallel to a direction defined by the length L2, which is about perpendicular to the direction defined by the depth D2. Therefore, the flow directions have to make about 90 degree turns in the distribution chamber 242 and the collection chamber 244. The distribution chamber 242 and the collection chamber 244 may be configured to help the fluid flows make the turns, and help reduce the pressure drop in the fluid flows.

The distribution chamber 242 and the collection chamber 244 are configured to have continuously smooth contours connecting the distribution opening 232 with the fluid entrance 212 and connecting the collection opening 234 with the fluid exit 214 respectively. The continuously smooth surface contours are contours configured to generally not have an angular and/or sharp turn(s), a sharp edge(s) and a surface feature(s) that is traverse to the fluid flow directions so as to help reduce pressure drop and fluid separations in the fluid flows by minimizing flow separations and abrupt changes in flow momentum.

The fluid entrance 212 and the fluid exit 214 generally have circular shaped profiles. The distribution opening 232 and the collection opening 234 generally have elongated rectangular shaped profiles, which are generally different from the profiles of the fluid entrance 212 and the fluid exit 214. The continuously smooth surface contours of the distribution chamber 242 and the collection chamber 244 are configured to provide gradual and smooth transitions between the fluid entrance 212 or the fluid exit 214 and the distribution opening 232 or the collection opening 234 respectively, which may help reduce pressure drop and fluid separations in the fluid flows.

In the orientation as shown in FIGS. 2B and 2C, the distribution chamber 242 generally has a reversed-funnel-like transition from the fluid entrance 212 to the distribution opening 232, which generally gradually enlarges from the fluid entrance 212 to the distribution opening 232. The collection chamber 244 generally has a funnel-like transition from the collection opening 234 to the fluid exit 214, which generally gradually funnels from the collection opening 234 to the fluid exit 214.

In operation, in the distribution chamber 242, as shown by arrows in FIG. 2C, the fluid flow flows from a left side to a right side of the distribution chamber 242 in the orientation as shown in FIGS. 2B and 2C. The reverse-funnel-like transition is configured to expand in the fluid flow direction, and the continuously smooth contours 281 of the distribution chamber 242 may help the fluid flow to expand from the fluid entrance 212 on the left side to the distribution opening 232 in the direction defined by the length L2.

In the collection chamber 244, the fluid flow also flows from a left side to a right side of the collection chamber 244 in the orientation as shown in FIGS. 2B and 2C. The funnel-like transition is configured to funnel in the fluid flow direction, and the continuously smooth surface contours 282 of the collection chamber 244 may help direct the fluid flow to contract from the collection opening 234 to the fluid exit 214 on the right side in the direction defined by the length L2.

The partition 236 has a first partition surface 236*a* and a second partition surface 236*b*. The first partition surface 236*a* is generally configured to face the distribution chamber 242, and the second partition surface 236*b* is generally configured to face the collection chamber 244. The first partition surface 236*a* has a first conically shaped portion 262 concaved into the collection chamber 244. The second partition surface 236*b* has a second conically shaped portion 264 concaved into the distribution chamber 242. The first and second conically shaped portions 262 and 264 may help the fluid flows make smooth turns from the fluid entrance 212 or the collection chamber 244 to the distribution chamber 242 or the fluid exit 214 respectively.

The fluid entrance 212 and the fluid exit 214, which generally have circular profiles, have diameters D12 and D14 respectively. The diameters D12 and D14 are generally larger than a height H12 of the distribution chamber 242 or a height H14 of the collection chamber 244. The height H12 and the height H14 are often different. The first conically shaped portion 262 can help a portion of the process fluid to make a smooth downward turn when the process fluid flows from the fluid entrance 212 into the distribution chamber 242 that is positioned below the collection chamber 244. The second conically shaped portion 264 can help direct a portion of process fluid toward the fluid exit 214 when the process fluid flows from the collection chamber 244, which is positioned above the distribution chamber 242, to the fluid exit 214.

Figure 2E:
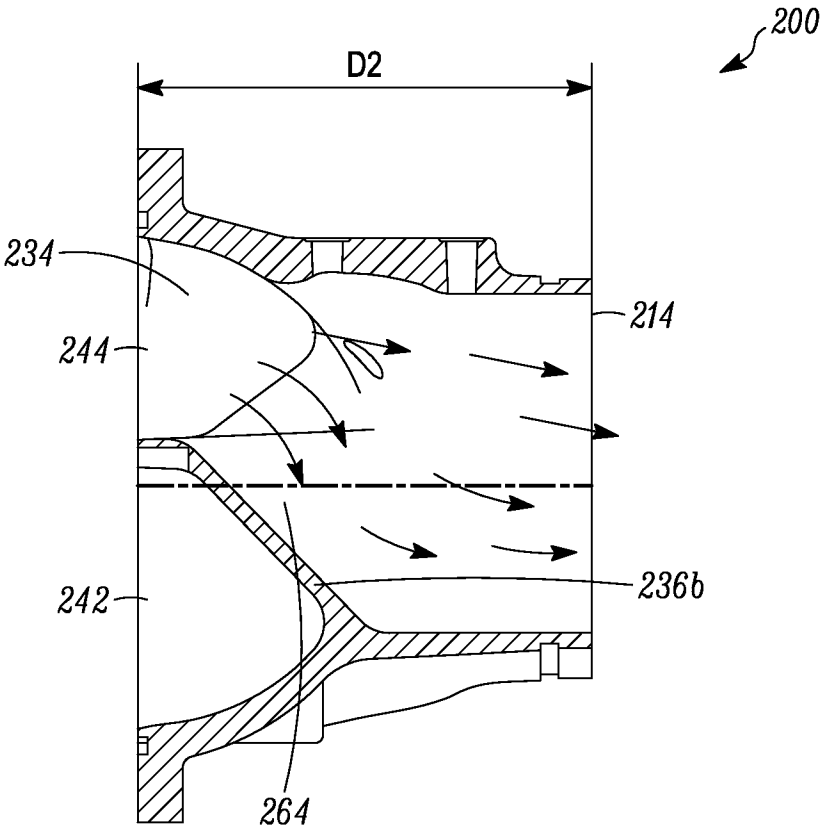
Figure 2D:
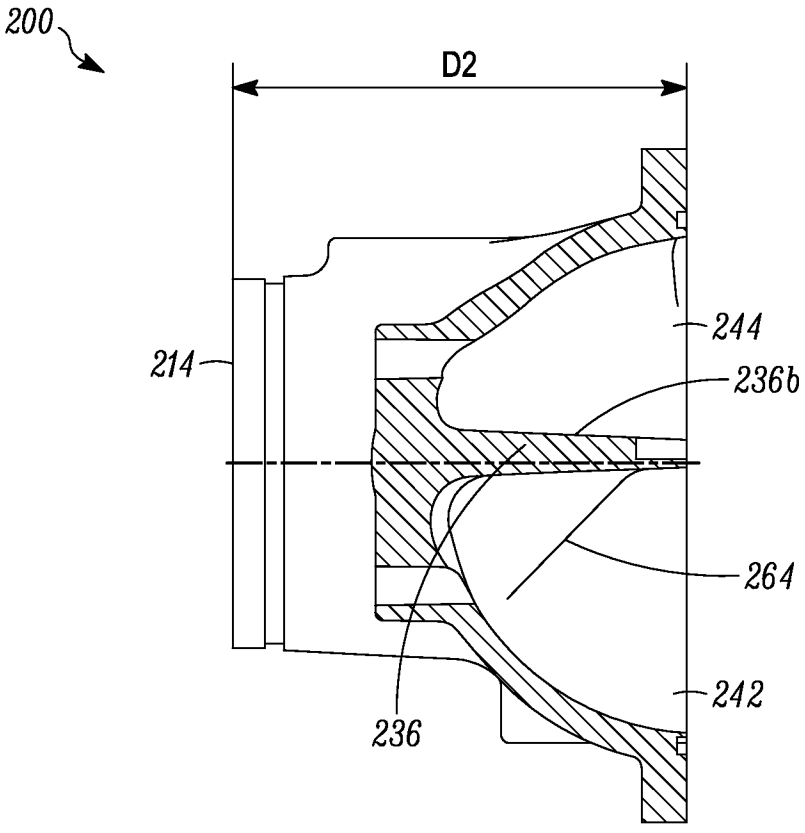
Figure 2G:
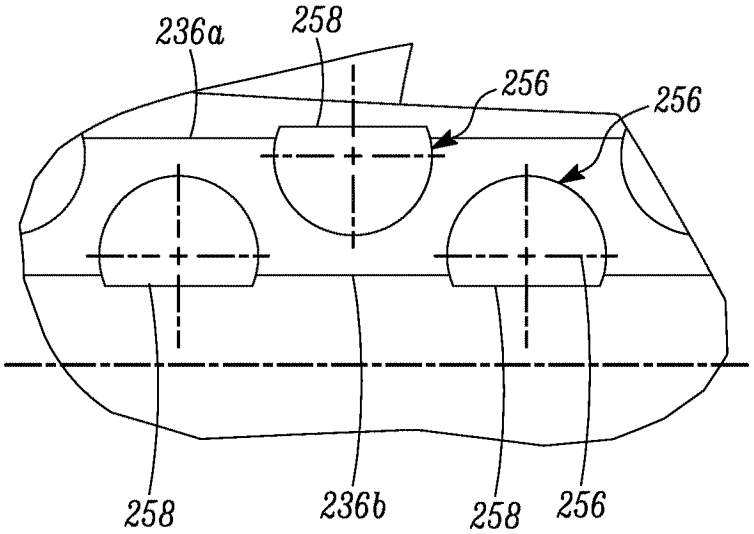
Figure 2F:
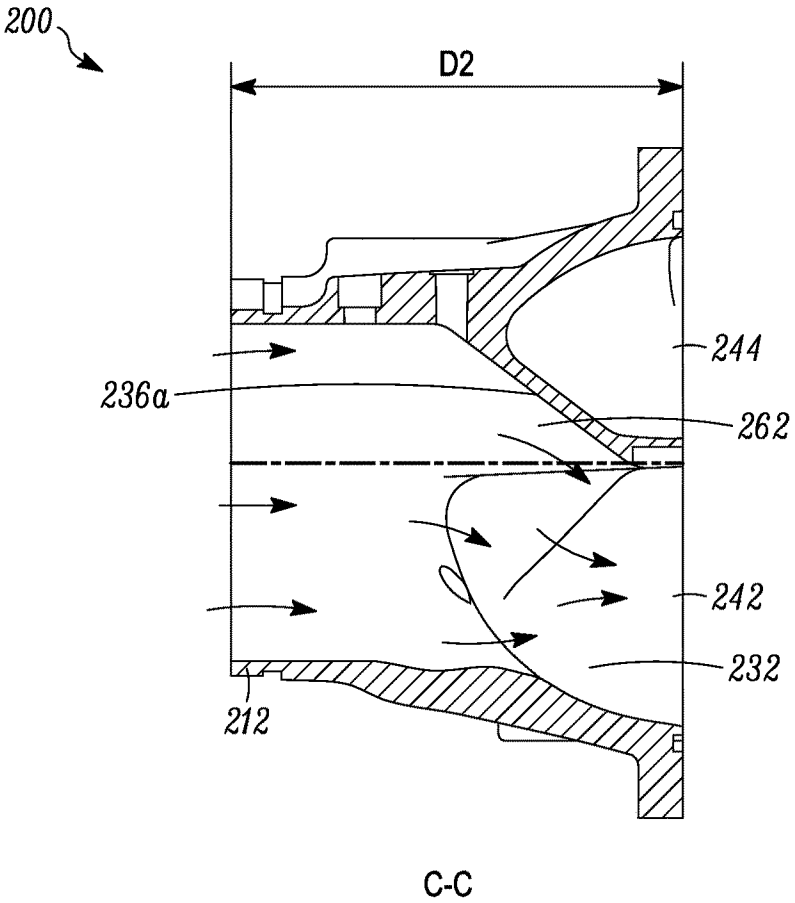

FIGS. 2D to 2F illustrate cross section views along lines A-A, B-B and C-C in FIG. 2A respectively. FIG. 2D is a cross section view along the line A-A, which is positioned at about a half way along the length L2. The cross section view illustrates the cross section with a view of the fluid exit 214. The collection chamber 244 is generally positioned above the distribution chamber 242 in the orientation shown, and the collection chamber 244 and the distribution 242 are separated by the partition 236. The second partition surface 236*b* has the second conically shaped portion 264 concaved into the distribution chamber 242.

As shown in FIG. 2D, the cross section of the distribution chamber 242 and the cross section of the collection chamber 244 have smooth contours.

FIG. 2E illustrates a cross section along the line B-B, which intersects the fluid exit 214. FIG. 2E illustrates that the collection chamber 244 has smooth contours connecting the fluid exit 214 and the collection opening 234. The distribution chamber 242 also has smooth contours.

The second partition surface 236*b* has the second conically shaped portion 264 concaved into the distribution chamber 242. As illustrated by arrows in FIG. 2E, the second conically shaped portion 264 may help direct the fluid toward the fluid exit 214.

FIG. 2F illustrates a cross section along the line C-C, which intersects the fluid entrance 212. FIG. 2F illustrates that the distribution chamber 242 has smooth contours connecting the fluid entrance 212 and the distribution opening 232. The collection chamber 244 also has smooth contours.

The first partition surface 236*a* has the first conically shaped portion 262 concaves into the collection chamber 244. As illustrated by arrows in FIG. 2F, the first conically shaped portion 262 can help direct a portion of the process fluid downwardly toward the distribution opening 232.

FIG. 2G illustrates an enlarged portion of area G of the partition 236 in FIG. 2C. The partition 236 is configured to have a plurality of pockets 256 distributed along an edge of the partition 236 in the direction defined by the length L2. The pockets 256 are configured to accept the inlets (e.g. the inlets 127 in FIG. 1B) or the outlets (e.g. the outlets 128 in FIG. 1B) of the heat exchanging tubes (e.g. the heat exchanging tubes 121 in FIGS. 1A and 1B) along the imaginary line dividing the tube bundle into the top portion including the outlets of the tube bundle and the bottom portion including the inlets of the tube bundle. Openings 258 of the pockets 256 configured to accept inlets are generally configured to open at the first partition surface 236*a*. The openings 258 of the pockets 256 configured to accept outlets are generally configured to open at the second partition surface 236*b*. The pockets 256 can help the partition 236 separate the distribution chamber 242 and the collection chamber 244.

Comparative Study

Operational pressure drop in a water head were compared between a traditional water head without continuously smooth surface contours that connecting the fluid entrance or exit with the distribution or collection opening respectively (e.g. the distribution chamber 242 and the collection chamber 244 with smooth contours as described herein), and an embodiment of the water head as described herein. For example, when compared to one traditional water head with side-by-side arrangement without smooth contours, the embodiment of the water head as described herein has about 10% less pressure drop, compared to the water head without the continuously smooth contours.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What claimed is:

1. A water head for an evaporator comprising:

a fluid entrance;

a fluid exit, the fluid entrance and the fluid exit positioned in a side-by-side fashion relative to a direction defined by a length of the water head;

a distribution opening;

a collection opening, the distribution opening and the collection opening positioned in an under-over fashion relative to the direction defined by the length of the water head, the fluid entrance and the fluid exit being at an external side of the water head, the distribution opening and the collection opening being at a shell-facing side of the water head, a depth of the water head extends from the external side to the shell-facing side of the water head;

a distribution chamber;

a collection chamber; and a partition separating the distribution chamber from the collection chamber in the direction defined by the length of the water head, the partition including a plurality of pockets to accept heat exchange tubes, wherein on the shell-facing side of the water head, there is a height of the distribution chamber, and there is a height of the collection chamber, the height of the distribution chamber extends from the partition to a bottom inner wall of the water head, the height of the collection chamber extends from the partition to a top inner wall of the water head, at the shell-facing side of the water head, the distribution opening and the collection opening are generally rectangular-shaped, the height of the distribution chamber is larger than the height of the collection chamber, the fluid entrance and the fluid exit are circular-shaped, a diameter of the fluid entrance is larger than the height of the distribution chamber or the height of the collection chamber, and a diameter of the fluid exit is larger than the height of the distribution chamber or the height of the collection chamber, wherein the fluid entrance is in fluid communication with the distribution opening through the distribution chamber, the fluid exit is in fluid communication with the collection opening through the collection chamber, the distribution chamber is configured to have continuously smooth surface contours connecting the fluid entrance and the distribution opening, the collection chamber is configured to have continuously smooth surface contours connecting the fluid exit and the collection opening, the water head is configured to form a first flow path from the fluid entrance to the distribution chamber through the depth of the water head in the direction defined by the depth of the water head, the water head is configured to form a second flow path from the collection chamber to the fluid exit through the depth of the water head in the direction defined by the depth of the water head, the water head is configured to direct a process fluid entering the fluid entrance in the direction defined by the depth of the water head and then direct the process fluid to turn in the direction defined by the length of the water head, the water head is configured to direct the process fluid to flow in the direction defined by the length of the water head and then direct the process fluid to turn in the direction defined by the depth of the water head to exit the fluid exit, wherein the distribution chamber has a reversed-funnel-like transition in the direction defined by the depth of the water head from the fluid entrance to the distribution opening, the reversed-funnel-like transition gradually enlarges from the fluid entrance to the distribution opening, wherein the collection chamber has a funnel-like transition in the direction defined by the depth of the water head from the collection opening to the fluid exit, the funnel-like transition gradually decreases from the collection opening to the fluid exit, and wherein the continuously smooth surface contours of the distribution chamber are configured to expand a fluid flow in the direction defined by the length of the water head, or the continuously smooth surface contours of the collection chamber are configured to contract a fluid flow in the direction defined by the length of the water head.

2. The water head of claim 1, wherein the distribution chamber is configured to have a conically shaped portion concaved into the collection chamber, the conically shaped portion is configured to direct a portion of a fluid toward the distribution opening when the fluid flows between the fluid entrance and the distribution opening.

3. The water head of claim 1, wherein the collection chamber is configured to have a conically shaped portion concaved into the distribution chamber, the conically shaped portion is configured to direct a portion of a fluid toward the fluid exit when the fluid flows between the collection opening and the fluid exit.

4. A method of directing a process fluid in a water head of an evaporator that comprises a fluid entrance;

a fluid exit, the fluid entrance and the fluid exit positioned in a side-by-side fashion relative to a direction defined by a length of the water head;

a distribution opening;

a collection opening, the distribution opening and the collection opening positioned in an under-over fashion relative to the direction defined by the length of the water head, the fluid entrance and the fluid exit being at an external side of the water head, the distribution opening and the collection opening being at a shell-facing side of the water head, a depth of the water head extends from the external side to the shell-facing side of the water head;

a distribution chamber configured to have continuously smooth surface contours connecting the fluid entrance and the distribution opening;

a collection chamber configured to have continuously smooth surface contours connecting the fluid exit and the collection opening; and a partition separating the distribution chamber from the collection chamber in the direction defined by the length of the water head, the partition including a plurality of pockets to accept heat exchange tubes, wherein on the shell-facing side of the water head, there is a height of the distribution chamber, and there is a height of the collection chamber, the height of the distribution chamber extends from the partition to a bottom inner wall of the water head, the height of the collection chamber extends from the partition to a top inner wall of the water head, at the shell-facing side of the water head, the distribution opening and the collection opening are generally rectangular-shaped, the height of the distribution chamber is larger than the height of the collection chamber, the fluid entrance and the fluid exit are circular-shaped, a diameter of the fluid entrance is larger than the height of the distribution chamber or the height of the collection chamber, and a diameter of the fluid exit is larger than the height of the distribution chamber or the height of the collection chamber, wherein the fluid entrance is in fluid communication with the distribution opening through the distribution chamber, the fluid exit is in fluid communication with the collection opening through the collection chamber, wherein the distribution chamber has a reversed-funnel-like transition in the direction defined by the depth of the water head from the fluid entrance to the distribution opening, the reversed-funnel-like transition gradually enlarges from the fluid entrance to the distribution opening, wherein the collection chamber has a funnel-like transition in the direction defined by the depth of the water head from the collection opening to the fluid exit, the funnel-like transition gradually decreases from the collection opening to the fluid exit, and wherein the continuously smooth surface contours of the distribution chamber are configured to expand a fluid flow in the direction defined by the length of the water head, or the continuously smooth surface contours of the collection chamber are configured to contract a fluid flow in the direction defined by the length of the water head, comprising:

directing a process fluid into the fluid entrance from the external side of the water head;

directing the process fluid entering the fluid entrance in the direction defined by the depth of the water head;

forming a first flow path from the fluid entrance to the distribution chamber through the depth of the water head in the direction defined by the depth of the water head;

gradually turning and expanding the process fluid in the direction defined by the length of the water head in the distribution chamber so as to direct the process fluid from the fluid entrance to the distribution opening; and distributing the process fluid to heat exchange tubes of the evaporator through the distribution opening.

5. The method of claim 4 further comprising:

receiving the process fluid from the heat exchange tubes of the evaporator in the collection opening;

gradually turning and contracting the process fluid in the direction defined by the length of the water head in the collection chamber so as to direct the process fluid from the collection opening to the fluid exit;

forming a second flow path from the collection chamber to the fluid exit through the depth of the water head in the direction defined by the depth of the water head; and directing the process fluid out of the water head of the evaporator through the fluid exit in the direction defined by the depth of the water head.

6. An evaporator comprising:

a shell, the shell defining a space, the shell having an end;

a plurality of tubes of a tube bundle positioned at a lower portion of the space, the plurality of tubes has inlets and outlets at the end of the shell; and a water head that comprises a fluid entrance;

a fluid exit, the fluid entrance and the fluid exit positioned in a side-by-side fashion relative to a direction defined by a length of the water head;

a distribution opening;

a collection opening, the distribution opening and the collection opening positioned in an under-over fashion relative to the direction defined by the length of the water head, the fluid entrance and the fluid exit being at an external side of the water head, the distribution opening and the collection opening being at a shell-facing side of the water head, a depth of the water head extends from the external side to the shell-facing side of the water head;

a distribution chamber configured to have continuously smooth surface contours connecting the fluid entrance and the distribution opening;

a collection chamber configured to have continuously smooth surface contours connecting the fluid exit and the collection opening; and a partition separating the distribution chamber from the collection chamber in the direction defined by the length of the water head, the partition including a plurality of pockets to accept at least one of the plurality of tubes, wherein on the shell-facing side of the water head, there is a height of the distribution chamber, and there is a height of the collection chamber, the height of the distribution chamber extends from the partition to a bottom inner wall of the water head, the height of the collection chamber extends from the partition to a top inner wall of the water head, at the shell-facing side of the water head, the distribution opening and the collection opening are generally rectangular-shaped, the height of the distribution chamber is larger than the height of the collection chamber, the fluid entrance and the fluid exit are circular-shaped, a diameter of the fluid entrance is larger than the height of the distribution chamber or the height of the collection chamber, and a diameter of the fluid exit is larger than the height of the distribution chamber or the height of the collection chamber, wherein the fluid entrance is in fluid communication with the distribution opening through the distribution chamber, the fluid exit is in fluid communication with the collection opening through the collection chamber, the water head is configured to form a first flow path from the fluid entrance to the distribution chamber through the depth of the water head in the direction defined by the depth of the water head, the water head is configured to form a second flow path from the collection chamber to the fluid exit through the depth of the water head in the direction defined by the depth of the water head, the water head is configured to direct a process fluid entering the fluid entrance in the direction defined by the depth of the water head and then direct the process fluid to turn in the direction defined by the length of the water head, and the water head is configured to direct the process fluid to flow in the direction defined by the length of the water head and then direct the process fluid to turn in the direction defined by the depth of the water head to exit the fluid exit, wherein the water head is positioned at the end of the shell, the inlets of the plurality of tubes are in fluid communication with the distribution chamber through the distribution opening, the outlets of the plurality of tubes are in fluid communication with the collection chamber through the collection opening, wherein the partition divides the plurality of tubes into a first portion and a second portion, the first portion is located toward a bottom of the tube bundle, and the second portion is located toward a top of the tube bundle, wherein the distribution chamber has a reversed-funnel-like transition in the direction defined by the depth of the water head from the fluid entrance to the distribution opening, the reversed-funnel-like transition gradually enlarges from the fluid entrance to the distribution opening, wherein the collection chamber has a funnel-like transition in the direction defined by the depth of the water head from the collection opening to the fluid exit, the funnel-like transition gradually decreases from the collection opening to the fluid exit, and wherein the continuously smooth surface contours of the distribution chamber are configured to expand a fluid flow in the direction defined by the length of the water head, or the continuously smooth surface contours of the collection chamber are configured to contract a fluid flow in the direction defined by the length of the water head.

7. A water head for an evaporator comprising:

a fluid entrance;

a fluid exit, the fluid entrance and the fluid exit positioned in a side-by-side fashion relative to a direction defined by a length of the water head;

a distribution opening;

a collection opening, the distribution opening and the collection opening positioned in an under-over fashion relative to the direction defined by the length of the water head, the fluid entrance and the fluid exit being at an external side of the water head, the distribution opening and the collection opening being at a shell-facing side of the water head, a depth of the water head extends from the external side to the shell-facing side of the water head;

a distribution chamber;

a collection chamber; and a partition separating the distribution chamber from the collection chamber in the direction defined by the length of the water head, wherein on the shell-facing side of the water head, there is a height of the distribution chamber, and there is a height of the collection chamber, the height of the distribution chamber extends from the partition to a bottom inner wall of the water head, the height of the collection chamber extends from the partition to a top inner wall of the water head, at the shell-facing side of the water head, the distribution opening and the collection opening are generally rectangular-shaped, the height of the distribution chamber is larger than the height of the collection chamber, the fluid entrance and the fluid exit are circular-shaped, a diameter of the fluid entrance is larger than the height of the distribution chamber or the height of the collection chamber, and a diameter of the fluid exit is larger than the height of the distribution chamber or the height of the collection chamber, wherein the fluid entrance is in fluid communication with the distribution opening through the distribution chamber, the fluid exit is in fluid communication with the collection opening through the collection chamber, the distribution chamber is configured to have continuously smooth surface contours connecting the fluid entrance and the distribution opening, the collection chamber is configured to have continuously smooth surface contours connecting the fluid exit and the collection opening, wherein in an end view of the water head at the shell-facing side of the water head, the continuously smooth surface contours of the distribution chamber are configured to increase in size in the direction defined by the length of the water head to expand a fluid flow in the direction defined by the length of the water head, or the continuously smooth surface contours of the collection chamber are configured to decrease in size in the direction defined by the length of the water head to contract a fluid flow in the direction defined by the length of the water head.

8. The water head of claim 7, wherein the distribution chamber has a reversed-funnel-like transition from the fluid entrance to the distribution opening, the reversed-funnel-like transition gradually enlarges from the fluid entrance to the distribution opening, and wherein the collection chamber has a funnel-like transition from the collection opening to the fluid exit, the funnel-like transition gradually decreases from the collection opening to the fluid exit.

9. The water head of claim 7, wherein the water head is configured to form a first flow path from the fluid entrance to the distribution chamber through the depth of the water head in the direction defined by the depth of the water head, the water head is configured to form a second flow path from the collection chamber to the fluid exit through the depth of the water head in the direction defined by the depth of the water head, the water head is configured to direct a process fluid entering the fluid entrance along the first flow path and then direct the process fluid to turn in the direction defined by the length of the water head, the water head is configured to direct the process fluid to flow in the direction defined by the length of the water head and then direct the process fluid to turn along the second flow path to exit the fluid exit, wherein the distribution chamber has a reversed-funnel-like transition in the direction defined by the depth of the water head from the fluid entrance to the distribution opening, the reversed-funnel-like transition gradually enlarges from the fluid entrance to the distribution opening, wherein the collection chamber has a funnel-like transition in the direction defined by the depth of the water head from the collection opening to the fluid exit, the funnel-like transition gradually decreases from the collection opening to the fluid exit.

* * * * *